US006626714B2

(12) United States Patent
Nozue

(10) Patent No.: US 6,626,714 B2
(45) Date of Patent: Sep. 30, 2003

(54) OIL PUMP ARRANGEMENT FOR MARINE DRIVE

(75) Inventor: Toshihiro Nozue, Shizuoka (JP)

(73) Assignee: Sanshin Kogyo Kabushiki Kaisha (JP)

( * ) Notice: Subject to any disclaimer, the term of this patent is extended or adjusted under 35 U.S.C. 154(b) by 22 days.

(21) Appl. No.: 10/066,507

(22) Filed: Jan. 31, 2002

(65) Prior Publication Data

US 2002/0115361 A1 Aug. 22, 2002

Related U.S. Application Data

(60) Provisional application No. 60/322,483, filed on Sep. 13, 2001, and provisional application No. 60/322,228, filed on Sep. 13, 2001.

(30) Foreign Application Priority Data

Jan. 31, 2001 (JP) ..... 2001-023085
Mar. 30, 2001 (JP) ..... 2001-100650

(51) Int. Cl.[7] ..... B63H 21/10
(52) U.S. Cl. ..... 440/88 L
(58) Field of Search ..... 440/88 L; 123/196 W; 184/6.28

(56) References Cited

U.S. PATENT DOCUMENTS

| | | | | |
|---|---|---|---|---|
| 4,475,488 | A | * 10/1984 | Odashima | 123/73 AD |
| 4,787,832 | A | 11/1988 | Fukasawa et al. | |
| 5,549,492 | A | 8/1996 | Yamamoto et al. | |
| 5,558,456 | A | 9/1996 | Nakase et al. | |
| 5,701,872 | A | 12/1997 | Kaku et al. | |
| 5,755,606 | A | * 5/1998 | Takahashi et al. | 440/84 |
| 5,778,848 | A | 7/1998 | Takahashi et al. | |
| 5,860,402 | A | 1/1999 | Sakurai et al. | |
| 5,876,188 | A | 3/1999 | Okamoto | |
| 6,033,273 | A | 3/2000 | Nozue et al. | |
| 6,059,619 | A | 5/2000 | Nozue | |
| 6,067,951 | A | 5/2000 | Kitajima | |
| 6,149,475 | A | 11/2000 | Tasaka et al. | |
| 6,192,853 | B1 | 2/2001 | Natsume | |

OTHER PUBLICATIONS

Parts Catalogue, Model Year 1996, F50 (TR/TH) U (62Y) T50 (TR) U (64J), 3 Pages.
Parts Catalogue, Model Year 1997, F50TRV (62Y) T50TRV (64J), 3 Pages.
Parts Catalogue, Model Year 1998, F50TRW (62Y) F50THW (62Y) F50TRW (64J), 3 Pages.
Parts Catalogue, Model Year 1999, F80TRX (67G) F100TRX (67F), 2 Pages.
Parts Catalogue, Model Year 2000, F40ESRY (67C) F40MHY (67C) F40TLRY (67C), 3 Pages.
Parts Catalogue, Model Year 2000, F15EHY (66M) F15MHY (66M), 4 Pages.
Parts Catalogue, Model Year 2000, F115TRY (68V) LF115TRY (68W), 6 Pages.
Parts Catalogue, Model Year 2000, F80TLRY (67G) F100TLRY (67F), 8 Pages.
Copending patent application; Ser. No. 09/860,269, filed May 18, 2001, Entitled Shaft Coupling for Outboard Motor, in the names of Jun Nakata and Yasuhiko Shibata, assigned to Sanshin Kogyo Kabushiki Kaisha.

* cited by examiner

*Primary Examiner*—Ed Swinehart
(74) *Attorney, Agent, or Firm*—Knobbe, Martens, Olson & Bear, LLP.

(57) ABSTRACT

A marine drive includes an oil pump assembly circumferentially mounted on a rotating shaft. The pump assembly defines a pump chamber. An upper seal member is provided above the pump chamber to effectuate a seal with the shaft so that foreign matter will be inhibited from passing downwardly past the upper seal. An intermediate seal member is provided below the pump chamber and also effectuates a seal with the shaft. The intermediate seal member minimizes leakage of oil from the chamber downwardly past the intermediate seal, and is more specifically directed to inhibit invasion of foreign matter, such as water, upwardly past the seal member. A lower seal member is provided below the intermediate seal member and also effectuates a seal with the shaft. The lower seal member acts as another barrier to inhibit leakage of oil downwardly past the lower seal and invasion of foreign matter upwardly past the lower seal.

35 Claims, 7 Drawing Sheets

OIL PUMP ARRANGEMENT FOR MARINE DRIVE

PRIORITY INFORMATION

This application is based on and claims priority to Japanese Patent Application Nos. 2001-100650, filed Mar. 30, 2001, and 2001-023085, filed Jan. 31, 2001, and to U.S. Provisional Application Nos. 60/322,483 and 60/322,228, both of which were filed on Sep. 13, 2001, the entire contents of all of these applications are hereby expressly incorporated by reference.

BACKGROUND OF THE INVENTION

1. Field of the Invention

The present invention relates generally to an oil pump arrangement for a marine drive, and more particularly to an improved seal arrangement for an oil pump that is driven by a rotating shaft.

2. Description of the Related Art

An outboard motor typically comprises a power head and a housing unit that depends from the power head. The power head includes an internal combustion engine generally configured to drive a vertically-extending crankshaft that is coupled with a driveshaft. The driveshaft depends into the housing unit and drives a propulsion device of the outboard motor.

A lubrication system distributes lubricant to various engine components. The lubrication system can include an oil pump that circumferentially surrounds and is driven by the crankshaft and/or driveshaft. A seal arrangement can be provided in order to minimize oil leakage from the oil pump. Such a seal arrangement can include a seal member disposed below the oil pump chamber and configured to engage the surface of the crankshaft so that oil from the pump will not leak downwardly past the seal member. Such oil leakage is wasteful and can cause damage to other outboard motor components.

A cooling system of the outboard motor can direct a flow of water through a driveshaft housing in order to cool some components and systems such as, for example, and exhaust system. During operation of the outboard motor, at least some of the water in the housing can often splash onto the oil pump. The seal member is configured to stop oil from the oil pump from leaking downwardly past the seal, and is not as effective at inhibiting splashed water from invading upwardly past the seal member and into the oil pump. Such invading water mixes with oil in the oil pump and causes an emulsion effect, which quickens deterioration of the oil.

SUMMARY OF THE INVENTION

The preferred embodiments of the present invention provide an outboard motor with an oil pump assembly having a sealing arrangement configured to inhibit leakage of oil from the lubrication system and to inhibit invasion of foreign matter, such as water, into the oil pump.

In accordance with one aspect, the present invention comprises an outboard motor with an engine having a substantially vertically-oriented crankshaft, a driveshaft coupled with the crankshaft of the engine so as to rotate therewith, and a lubrication system to supply lubricant to at least one component of the engine. The lubrication system comprises an oil pump assembly having a housing. The housing defines a pump chamber that at least substantially encircles a portion of the crankshaft. A rotor is disposed within the pump chamber and is configured to rotate with the crankshaft. A first seal member is disposed above the chamber and is configured to sealingly engage the crankshaft. A second seal member is disposed below the chamber and is configured to sealingly engage the crankshaft. A third seal member is disposed below the second seal member and is configured to sealingly engage the driveshaft.

In accordance with another aspect of the present invention, a marine drive comprises an internal combustion engine adapted to drive a propulsion device through a rotating shaft. A lubrication system of the drive comprises an oil pump assembly. The pump assembly comprises a housing configured to circumferentially surround the shaft. The housing also defines a pump chamber. A rotor is arranged within the pump chamber and is configured to rotate with the shaft. A seal arrangement comprises a lower seal member disposed below the pump chamber. The lower seal member includes a seal lip adapted to slidably engage the shaft. The seal lip extends toward the shaft in a downwardly-inclined direction.

In accordance with a further aspect, the present invention provides a marine drive comprising an internal combustion engine and a lubrication system. The engine is configured to drive a propulsion device and includes a rotating vertical shaft. The lubrication system comprises an oil pump assembly configured to be driven by the vertical shaft. The oil pump assembly comprises a housing defining a pump chamber through which the shaft extends. An upper seal member is positioned above the pump chamber and is configured to sealingly engage the shaft. A lower seal member is positioned below the pump chamber and is configured to sealingly engage the shaft. The upper seal member is configured so that oil will leak upwardly past the seal when oil pressure in the chamber exceeds a first threshold value. The lower seal member is configured so that oil will leak downwardly past the seal when oil pressure in the chamber exceeds a second threshold value, and the first threshold value is less than the second threshold value.

In accordance with a still further aspect, an outboard motor comprises a drive unit and a mounting mechanism for mounting the drive unit onto a watercraft. The mounting mechanism comprises at least one dampener adapted to dampen vibrations from the drive unit. The drive unit comprises a reciprocating internal combustion engine configured to drive a shaft as a result of reciprocal movement of at least one component of the engine. The engine comprises a lubrication system for delivering lubricant to at least one component of the engine. The lubrication system includes a lubricant pump positioned vertically higher than the dampener and coupled with the shaft so that the shaft extends through a housing of the lubricant pump. The housing defines a pump chamber therewithin and comprises a first seal member disposed below the pump chamber, a second seal member below the first seal member, and a third seal member below the second seal member. Each of the seal members is disposed circumferentially around the shaft. The first and second seal members are configured to inhibit lubricant from flowing down the shaft past the seal members. The third seal member is configured to inhibit fluids from flowing up the shaft past the third seal member toward the chamber.

In accordance with a yet further aspect, an outboard motor comprises a drive unit and a mounting mechanism for mounting the drive unit onto a watercraft. The mounting mechanism comprises at least one dampener adapted to dampen vibrations from the drive unit. The drive unit comprises a reciprocating internal combustion engine configured to drive a shaft assembly as a result of reciprocal movement of at least one component of the engine. The engine comprises a lubrication system for delivering lubricant to at least one component of the engine. The lubrication system includes a lubricant pump positioned vertically higher than the dampener and coupled with the shaft assembly so that at least a portion of the shaft assembly extends through a housing of the lubricant pump. The housing defines a pump chamber therewithin and comprising a first seal member disposed below the pump chamber, a second seal member below the first seal member, and a third seal member below the second seal member. Each of the seal members is disposed circumferentially around a portion of the shaft assembly. The first and second seal members are configured to inhibit lubricant from flowing down the shaft assembly past the seal members. The third seal member is configured to inhibit fluids from flowing up the shaft assembly past the third seal member and toward the chamber.

BRIEF DESCRIPTION OF THE DRAWINGS

These and other features, aspects and advantages of the present invention will now be described with reference to the drawings of preferred embodiments, which embodiments are intended to illustrate and not to limit the present invention. The drawings comprise seven figures.

DETAILED DESCRIPTION OF THE PREFERRED EMBODIMENTS

Overall Construction

Figure 1:
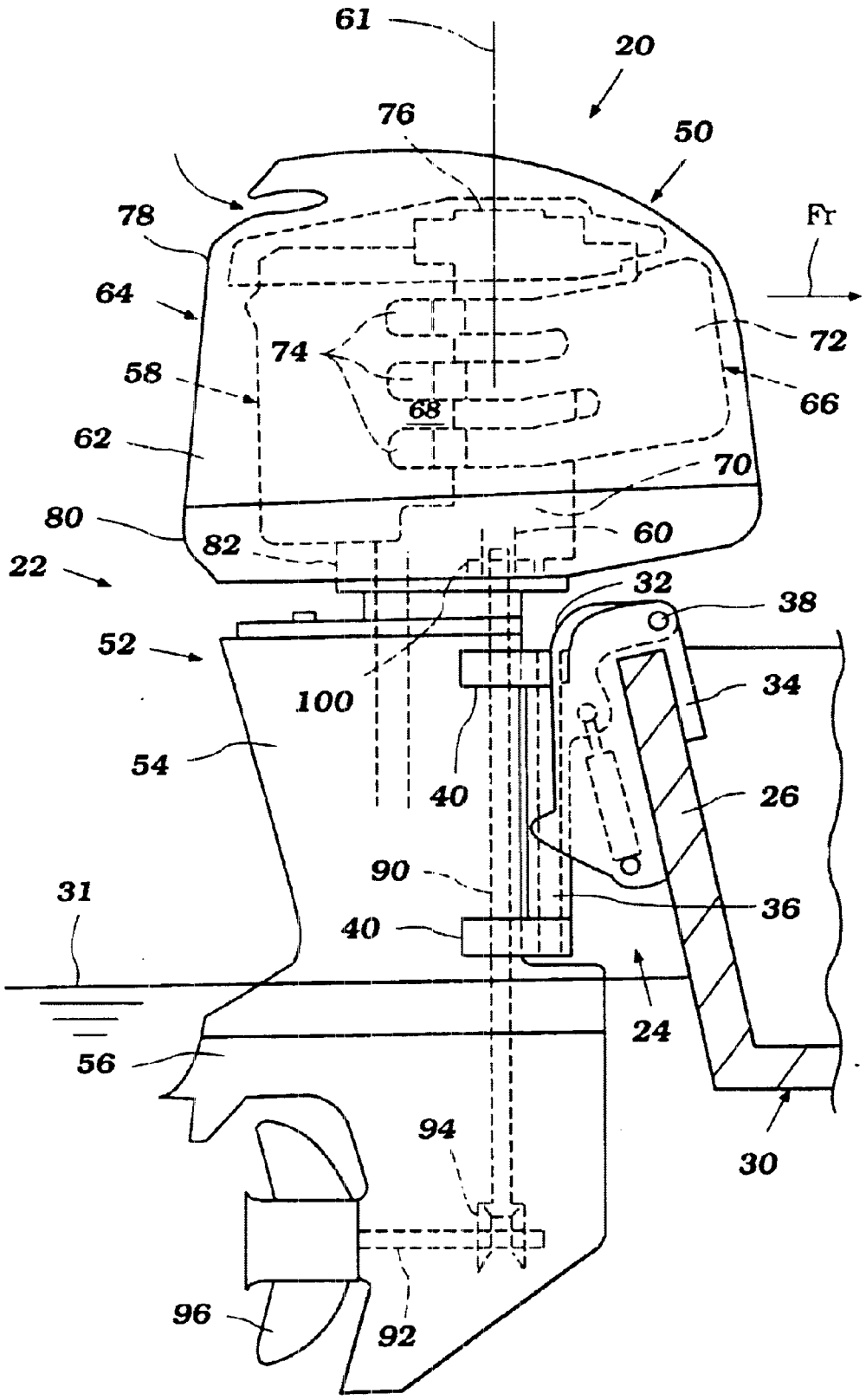
FIG. 1 is a side elevation view of an outboard motor employing a shaft-driven oil pump arrangement. An associated watercraft is partially shown in section.

With primary reference initially to FIG. 1, an overall construction of an outboard motor 20 is shown. In the illustrated arrangement, the outboard motor 20 generally comprises a drive unit 22 and a bracket assembly 24. The bracket assembly 24 supports the drive unit 22 on a transom 26 of an associated watercraft 30 and places a marine propulsion device in a submerged position with the watercraft 30 resting relative to a surface of a body of water 31. The bracket assembly 24 is configured in any suitable manner, and preferably comprises a swivel bracket 32, a clamping bracket 34, a steering shaft 36 and a pivot pin 38. A pair of mount members 40 secure the bracket assembly 24 to the drive unit 22. In some embodiments (see FIG. 6), resilient dampeners 42 are disposed in recesses 44 formed in the mount members 40 so as to reduce the transmission of vibrations between the watercraft 30 and the motor 20.

As used through this description, the terms "forward," "forwardly" and "front" mean at or to the side where the bracket assembly 24 is located, unless indicated otherwise or otherwise readily apparent from the context use. The arrows indicate the forward direction. The terms "rear," "reverse," "backwardly" and "rearwardly" mean at or to the opposite side of the front side.

As used in this description, the term "horizontally" means that the subject portions, members or components extend generally in parallel to the water surface (i.e., generally normal to the direction of gravity) when the associated watercraft 30 is substantially stationary with respect to the water surface and when the drive unit 22 is not tilted (i.e., is placed in the position shown in FIG. 1). The term "vertically" in turn means that portions, members or components extend generally normal to those that extend horizontally. The terms "up" and "upward" refer to a position that is vertically higher than another position or refer to movement toward increasing vertical height. The terms "down" and "downward" mean essentially the opposite of "up" and "upward."

The drive unit 22 comprises a power head 50 and a housing unit 52, which includes a driveshaft housing 56 and a lower unit 56. The power head 50 is disposed atop the housing unit 52 and includes an internal combustion engine 58, which drives a crankshaft 60. The crankshaft 60 rotates about a longitudinal axis 61.

In the outboard motor 20 shown in FIG. 1, the engine 58 and other components are depicted in phantom lines because a variety of engine and component configurations can be used. For example, the embodiment depicted in FIG. 1 includes an engine 58 having a V-type arrangement. It is to be understood that this engine type merely exemplifies types of engines on which various aspects and features of the present invention can suitably be used. Engines having various numbers of cylinders, having other cylinder arrangements (opposing, etc.) and even operating on other combustion principles (e.g., crankcase compression two stroke or rotary) also can employ various features, aspects and advantages of the present invention.

Although the embodiments described herein comprise an outboard motor having a substantially vertical crankshaft, it is to be understood that aspects of the embodiments described herein can have particular utility with other types of marine drives (i.e., inboard motors, inboard/outboard motors, etc.); with certain land vehicles such as lawn mowers, go-karts, motorcycles, all-terrain vehicles and the like; with stationary engines; and for some applications that will become apparent to the person of ordinary skill in the art. Such other embodiments need not necessarily employ a vertical crankshaft.

The engine 58 is positioned within a generally enclosed cavity 62 defined by a protective cowling assembly 64, which preferably is made of plastic. As such, the cowling assembly 64 generally protects the engine 58 from environmental elements. An air induction system 66 conveys air from within the cowling 64 to the engine 58 for combustion therein.

With continued reference to FIG. 1, the engine 58 has a cylinder block 68 defining six cylinder bores arranged in a V-type arrangement so that three cylinder bores are arranged in each of two cylinder banks. The cylinder bores extend generally horizontally, and the cylinders in each cylinder bank are disposed vertically one above another. A piston reciprocates within each cylinder bore. Cylinder head members together with the associated pistons and cylinder bores preferably define six combustion chambers.

A crankcase member encloses a front end of the cylinder block 68 and, together with the cylinder block 66, defines a crankcase chamber 70. The crankshaft 60 extends generally vertically through the crankcase chamber 70 and can be journalled for rotation about a rotational axis by several bearing blocks. Connecting rods couple the crankshaft 60 with the respective pistons in a suitable manner so that reciprocal movement of the pistons rotates the crankshaft 60.

The air induction system 66 conveys air from within the cowling 64 to the engine combustion chambers for combustion therein. As shown in FIG. 1, the air induction system 66 comprises an intake silencer 72 disposed toward the front of the engine 58. Three runners extend on either side of the engine 58 to deliver air from the intake silencer 72 to respective combustion chambers.

A flywheel assembly 76 preferably is positioned atop the crankshaft 60 and is journalled for rotation with the crankshaft. The flywheel assembly typically comprises a flywheel magneto or AC generator that supplies power to various electrical components, such as a fuel injection system, an ignition system and an electronic control unit (ECU). The crankshaft 60 can also drive other engine components. For example, one or more camshafts can be driven by the crankshaft through a pulley system. Such a camshaft can be part of a shaft assembly, which includes one or more rotating shafts and associated components such as bearings.

With continued reference to FIG. 1, the protective cowling assembly 64 preferably comprises a top cowling member 78 and a bottom cowling member 80. The top cowling member 78 preferably is detachably affixed to the bottom cowling member 80 by a coupling mechanism so that a user, operator, mechanic or repairperson can access the engine 58 for maintenance or for other purposes. In some arrangements, the top cowling member 78 is hingedly attached to the bottom cowling member 80 such that the top cowling member 78 can be pivoted away from the bottom cowling member 80 for access to the engine 58. Preferably, such a pivoting allows the top cowling member 78 to be pivoted about the rear end of the outboard motor 20, which facilitates access to the engine 58 from within the associated watercraft 30.

The bottom cowling member 80 preferably has an opening through which an upper portion of an exhaust guide member 82 extends. The exhaust guide member 82 preferably is made of aluminum alloy and is affixed atop the driveshaft housing 54. The bottom cowling member 80 and the exhaust guide member 82 together generally form a tray. The engine 58 is placed onto this tray and can be affixed to the exhaust guide member 82. The exhaust guide member 82 also defines an exhaust discharge passage through which burnt charges (e.g., exhaust gases) from the engine 58 pass.

The driveshaft housing 54 is positioned below the exhaust guide member 82 and supports a driveshaft 90, which extends generally vertically through the driveshaft housing 54. The driveshaft 90 is journalled for rotation in the driveshaft housing 54 and is driven by the crankshaft 60. As discussed above with reference to a camshaft, a shaft assembly includes at least one shaft and associated components such as bearings. Each of the crankshaft 60 and driveshaft 90, taken alone or together, can be included in a shaft assembly.

The driveshaft housing 54 preferably defines an internal section of an exhaust system that leads the majority of engine exhaust gases to the lower unit 56. The internal section preferably also includes an idle discharge portion that is branched off from a main portion of the internal section and leads to an idle discharge port that preferably is formed through the driveshaft housing 65. In this manner, exhaust gases generated when the engine 58 is idling are discharged directly to the atmosphere through the idle discharge port.

The lower unit 56 depends from the driveshaft housing 54 and supports a propulsion shaft 92 that is driven by the driveshaft 90 through a transmission 94. The propulsion shaft 92 extends generally horizontally through the lower unit 56 and is journalled for rotation. A marine propulsion device is attached to the propulsion shaft 92. In the illustrated arrangement, the propulsion device is a propeller 96 that is affixed to an outer end of the propulsion shaft 97. The propulsion device, however, can take the form of a dual counter-rotating system, a hydrodynamic jet, or any of a number of other suitable propulsion devices.

The transmission 94 preferably is provided between the driveshaft 90 and the propulsion shaft 92, which lie generally normal to each other (i.e., at a 90° shaft angle), and couples together the two shafts 90, 92 by bevel gears. A clutch mechanism allows the transmission 94 to change the rotational direction of the propeller 96 among forward, neutral or reverse.

The lower unit 56 also defines an internal section of the exhaust system that is connected with the internal exhaust section of the driveshaft housing 54. A discharge port is formed through the hub of the propeller 96. At engine speeds above idle, the exhaust gases generally are routed through the discharge port and to the body of water surrounding the outboard motor 20. It is to be understood that the exhaust system can include a catalytic device at any location in the exhaust system to purify the exhaust gases.

An exhaust cooling system circulates water through the driveshaft housing 54 so as to cool the exhaust system and other components in the driveshaft housing 54.

Figure 2:
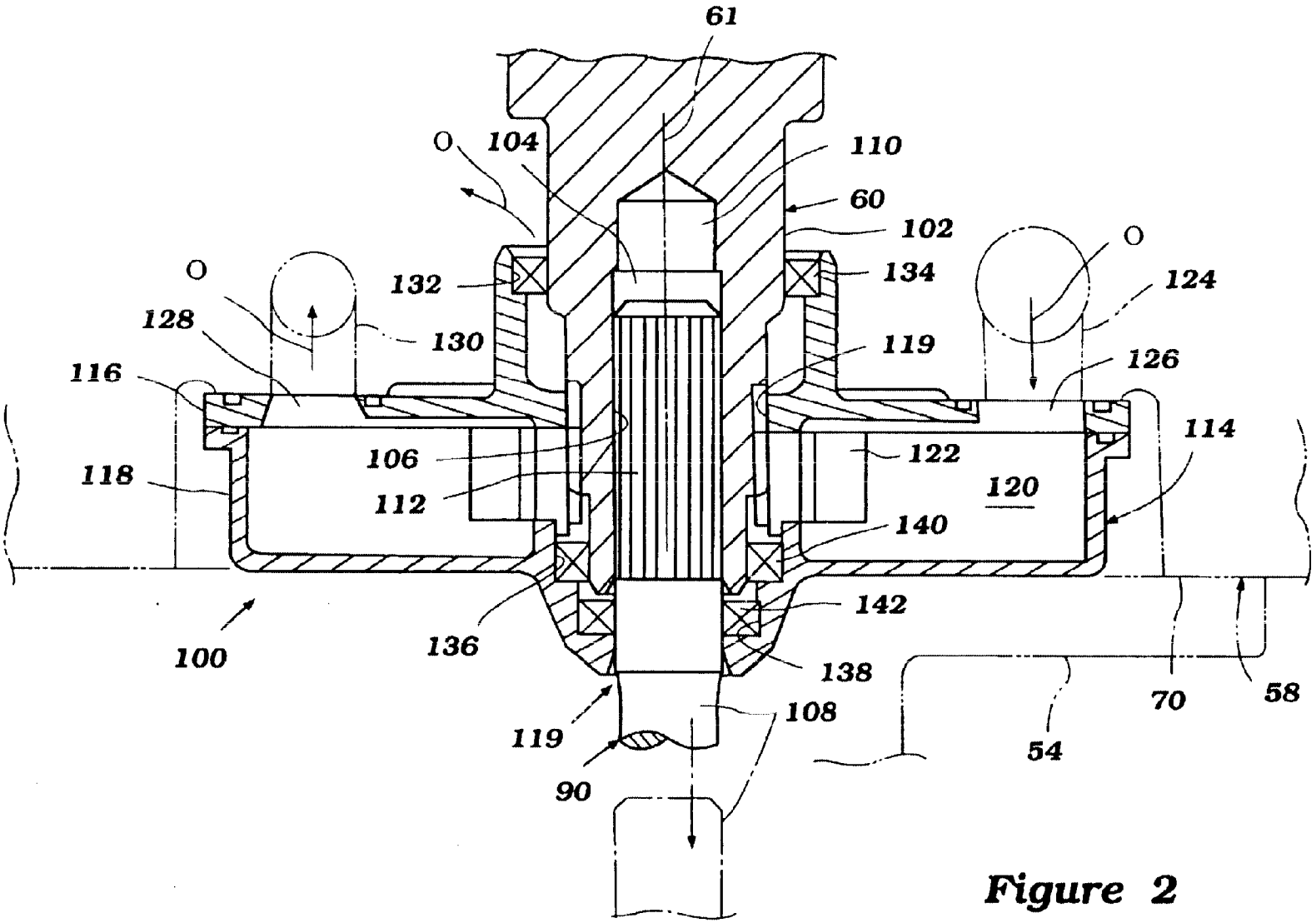
FIG. 2 is a partially sectioned view that enlarges an oil pump assembly shown in FIG. 1.

The engine employs a lubrication system for lubricating at least one and preferably a variety of engine components. A closed-loop type system preferably is employed in the illustrated embodiment. The lubrication system comprises a lubricant tank defining a reservoir cavity preferably positioned within the driveshaft housing 54. With reference to FIGS. 1 and 2, an oil pump assembly 100 is driven by the crankshaft 60 so as to pressurize the lubricant oil and to direct the pressurized lubricant through delivery passages and galleries to engine components that need lubrication. Such engine components include, for example, crankshaft bearings, connecting rods, and pistons, to name just a few. Lubricant return passages also are provided to return oil to the lubricant tank for recirculation. Preferably, the lubrication system further comprises a filter assembly to remove foreign matter (e.g., metal shavings, dirt, dust and water) from the lubricant oil before the oil is recirculated or delivered to the various engine components.

The engine 58 preferably employs other systems such as, for example, a fuel injection system, ignition or firing system and cooling system. The engine also preferably employs an ECU, which receives inputs from various sensors and controls certain engine components in response to such inputs so as to increase engine performance in various operating conditions.

As discussed above, and with reference to FIG. 2, the crankshaft 60 is coupled with the driveshaft 90 so that the shafts rotate together. In the illustrated embodiment, a bottom end 102 of the crankshaft 60 has a substantially cylindrical recessed portion 104 that extends coaxially with the crankshaft 60. An inner surface of the recessed portion 104 advantageously defines spline grooves 106. The recessed portion 104 in the illustrated arrangement is simply a blind hole formed in the end of the crankshaft 60.

A tip portion 108 of the driveshaft 90 is inserted into the recessed portion 104 of the crankshaft 60. The recessed portion 104 is deeply formed so that a grease pocket 110 is defined within the crankshaft 60 beyond the tip portion 108 of the driveshaft 90. The tip portion 108 of the driveshaft 90 is formed with spline grooves 112 that complement splines 106 of the recessed portion 104. The crankshaft 60 and driveshaft 90 are thus engaged for rotation with each other. However, when required for maintenance or the like, the driveshaft 90 can be removed from the crankshaft recessed portion 104, as shown in phantom lines in FIG. 2. It should be understood that the crankshaft 60 and driveshaft 90 can be coupled in other ways such as, for example, through a blind flange, splined sleeve, spacer member, etc.

Oil Pump Assembly

With continued reference to FIG. 2, the oil pump assembly 100 is mounted adjacent the engine crankcase 70 and circumferentially surrounds the coupling of the crankshaft 60 and driveshaft 90. The oil pump assembly 100 comprises a pump housing 114 which includes an upper member 116 and a lower member 118. Both the upper and lower members 116, 118 have apertures 119 formed therethrough in order to accommodate the crankshaft 60 and driveshaft 90.

The pump housing 114 defines a pump chamber 120 therewithin. In the illustrated embodiment, the oil pump comprises a trochoid type oil pump comprising a rotor 122 that is configured to rotate with the crankshaft 60. Oil "O" is delivered to the pump chamber 120 through an inlet pipe 124 and inlet port 126. The rotor 122 pressurizes this oil and delivers the pressurized oil to and through an outlet port 128. The pressurized oil continues through an outlet pipe 130 and is distributed to engine components.

The oil pump assembly 100 includes a seal arrangement for controlling oil leakage from the pump chamber 120 and for inhibiting invasion of foreign matter into the pump chamber 120. With continued reference to FIG. 2, the upper housing member 116 includes a circumferential seat 132 formed therein. A circular upper seal 134 is disposed in the seat 132 and engages the surface of the crankshaft 60 so as to create a seal with the crankshaft. In a similar manner, an intermediate seat 136 and a lower seat 138 are formed in the lower housing member 118 and an intermediate seal 140 and lower seal 142, respectively, are fit therein. The intermediate seal 140 engages the surface of the crankshaft 60 to create a seal below the pump chamber 120. The lower seal 142 engages the surface of the driveshaft 90 in order to provide a second seal below the pump chamber 120. In this manner, even when the driveshaft 90 is removed from the recessed portion 104 of the crankshaft 60, as depicted in phantom lines in FIG. 2, the pump chamber 120 remains sealed from the environment by the intermediate seal 140. Additionally, the intermediate and lower seals 140, 142 cooperate with each other so that even if one or both of the seals does not function properly, water invasion past the seals and into the pump chamber 120 is at least slowed and minimized.

Figure 3:
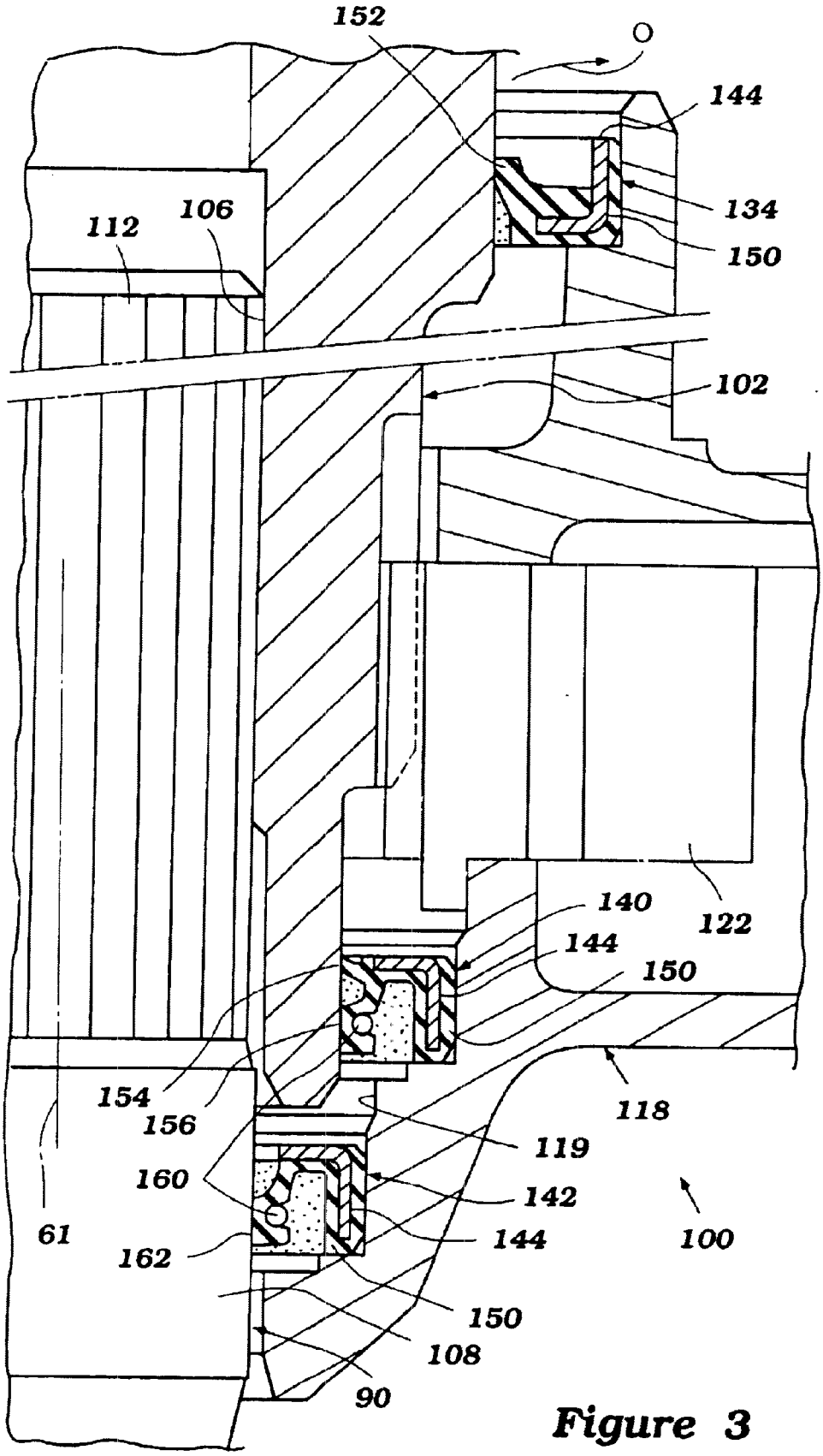
FIG. 3 is an enlarged close-up view of an embodiment of the oil pump assembly of FIG. 2.

With specific reference next to FIG. 3, an embodiment of a seal arrangement is depicted in greater detail. Each of the seal members 134, 140, 142 comprises a circular rigid frame 144. In the preferred embodiments, the frame 144 comprises a metallic material that is bent at an angle. However, it is to be understood that other rigid materials can be employed. A seal element 150 is attached to each rigid frame 144. In the preferred embodiments, the seal elements 150 comprise a rubber material that is connected to the metal frame 144 through a vulcanization process. It is to be understood that other suitable materials and manufacturing processes can be used to construct the seals. Also, various types and configurations of seal members and elements having other designs and constructions can be employed as long as they provide an acceptable seal.

Lips of each seal element extend towards and are configured to engage the surface of the crankshaft or driveshaft. The lip 152 of the upper seal 134 is inclined in a generally "uphill" direction. This means that the lip 152 slopes upwardly from the seal element 150 to the point at which the lip 152 engages the crankshaft 60. As such, the lip 152 is especially effective in inhibiting ingress of material from outside of the pump chamber 120 downwardly past the lip 152 and into the chamber 120. Additionally, the upper seal lip 152 is configured so that if pressures within the pump chamber 120 exceed a predetermined threshold level, oil "O" within the pump chamber 120 will leak in an upward direction past the lip 152. In the illustrated embodiment, the upper housing member 116 of the oil pump 100 abuts the crankcase 70 of the engine 58. Thus, oil that may leak upwardly past the upper seal 134 enters the crankcase 70, from which the oil will eventually be routed back into the oil pump chamber 120. In this manner, excess pressures can be relieved without oil escaping from the lubrication system. In additional embodiments, the pump assembly can be mounted so that the upper seal 134 does not open into the crankcase chamber 70. It is to be understood that an oil collection and draining mechanism can be provided for directing oil that leaks from the upper seal 134 back to the lubrication system.

In the illustrated embodiment, the seal element 150 of the intermediate seal 140 comprises an upper lip 154 and a lower lip 156. The upper lip 154 extends in an uphill direction so as to discourage oil from within the pump chamber 120 from leaking past the lip 154. The lower lip 156 extends generally in a "downhill" direction, and sealingly and slidably engages the surface of the crankshaft 60. The term "downhill" means that the lower lip 156 slopes generally downwardly from the seal element 150 to the point at which the lip 156 engages the crankshaft 60. A ring-shaped spring 160 helps to firmly press the lower lip 156 into engagement with the surface of the crankshaft 60. As such, a strong seal is created between the lower seal lip 156 and the crankshaft 60. With continued reference to FIG. 3, the lower seal 142 also includes a downhill-directed seal lip 162 that incorporates a ring-shaped spring 160.

In a variation of the illustrated embodiment, the uphill-directed upper lip 154 of the intermediate seal 140 may be eliminated, as the spring-reinforced lower lip 156 provides a strong, effective seal. In fact, the spring-reinforced lower lip 156 of the intermediate seal 140 creates a tighter seal with the crankshaft 60 than the lip 152 of the upper seal member 134, and thus can endure greater oil pressures without leaking. As such, oil will leak past the upper seal member 134 at a threshold oil pressure that is less than a pressure level at which oil would leak past the intermediate seal 140. Excess pressure within the pump 100 thus will likely be relieved by the leakage of oil past the upper seal 134 so that pump pressures do not reach levels that would prompt oil leakage past the intermediate seal 140. In this manner, oil that leaks in order to relieve pump pressure drains into the crankcase chamber 70 and remains within the lubrication system.

The seal arrangement of the embodiment illustrated in FIG. 3 provides a number of advantages. For example, as discussed above, when a watercraft 30 is being operated, water within the driveshaft housing 54 can splash against the driveshaft 90 and the oil pump housing 114. The tight fit and downhill-directed arrangement of the lower seal 142 effectively inhibits such water from penetrating upwardly past the lower seal 142. The presence of at least two downhill-directed, spring-reinforced seal lips 156, 162 further minimizes the possibility that foreign matter such as water will invade the pump chamber 120. Additionally, the placement of the lower seal 142 not only aids in protecting against water invasion into the pump chamber 120, but also discourages water invasion into the coupling between the crankshaft 60 and driveshaft 90.

Figure 4:
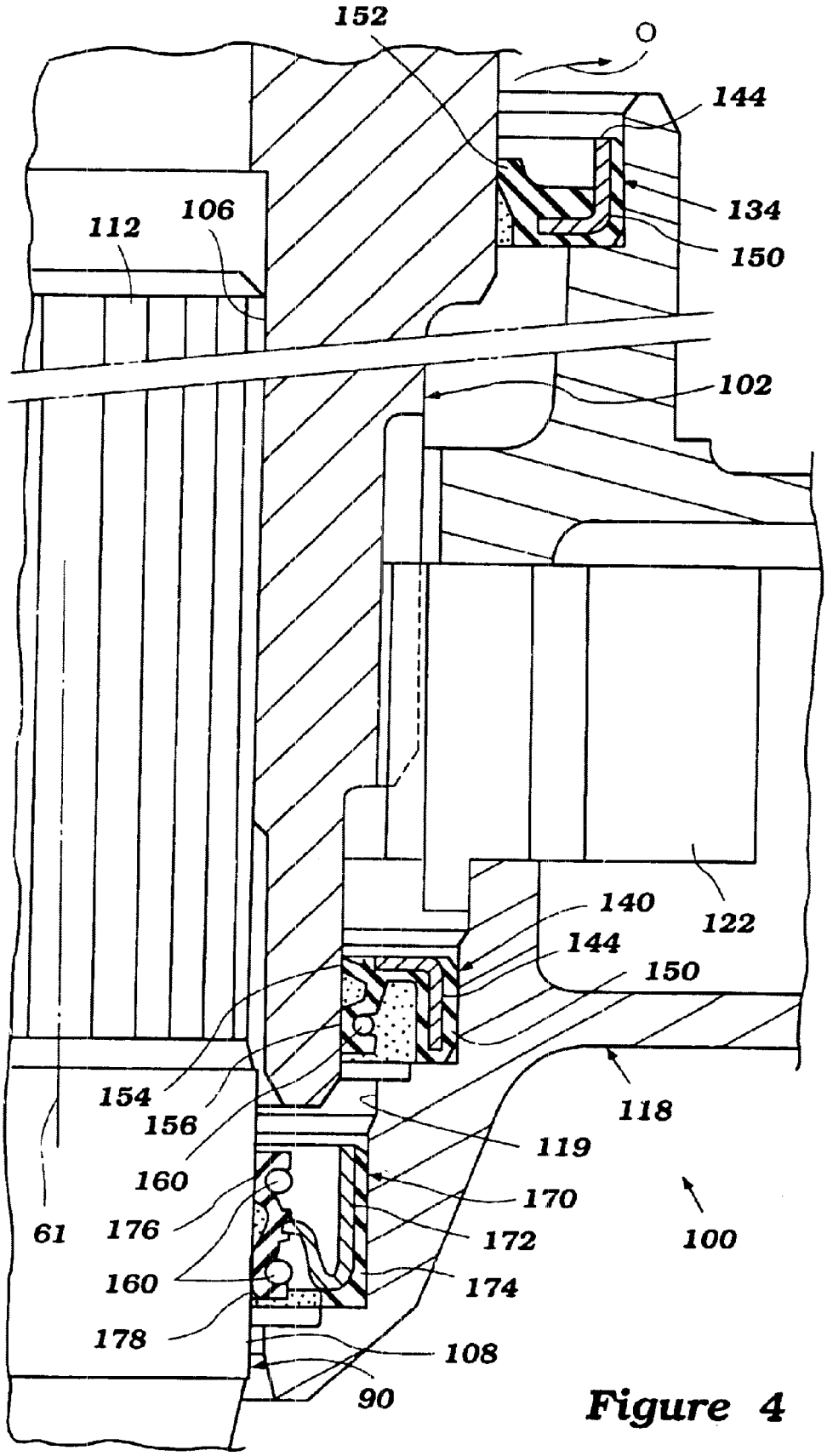
FIG. 4 is an enlarged close-up view of another embodiment of the oil pump assembly of FIG. 2.

With reference next to FIG. 4, another embodiment of a seal arrangement comprises an upper and intermediate seal 134, 140 that are configured substantially as discussed above with reference to FIG. 3. A lower seal 170, however, comprises a circular frame 172 and a seal element 174 having an upper lip 176 and a lower lip 178. A ring-shaped spring 160 is provided for each of the upper and lower lips in order to press the lips 176, 178 tightly against the surface of the driveshaft 90.

The upper lip 176 extends in a generally uphill direction, and thus is especially effective at inhibiting leakage of oil and the like in a downward direction. The lower lip 178 extends in a generally downhill direction, and is thus especially effective at inhibiting foreign matter such as water from passing by the seal in an upward direction.

This arrangement helps inhibit leakage of lubricating oil from the oil pump chamber 120 downwardly past the seals 140, 170. Oil that may leak past the intermediate seal 140 will likely become trapped between the intermediate seal 140 and the upper lip 176 of the lower seal 170. Additionally, grease from the coupling of the crankshaft 60 and driveshaft 90 will likely be inhibited from leaking past the lower seal 170. Also, the presence and retention of oil between the intermediate and lower seals 140, 170 serves as yet another barrier for inhibiting water from invading into the pump chamber 120.

Figure 5:
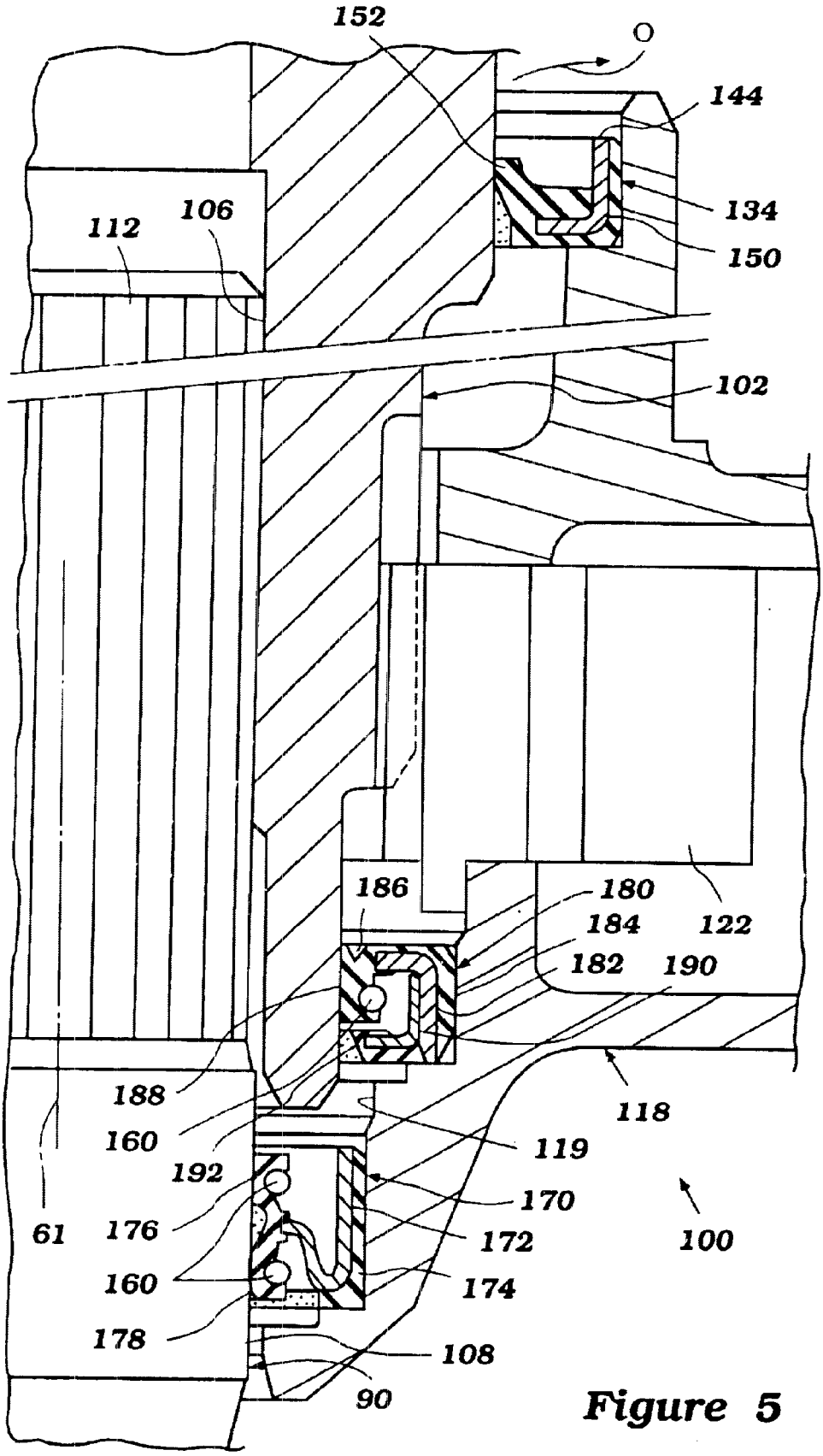
FIG. 5 is an enlarged close-up view of yet another embodiment of the oil pump assembly of FIG. 2.

With reference next to FIG. 5, another embodiment of a seal arrangement is illustrated. In this embodiment, an intermediate seal 180 comprises a first frame member 182 which supports a first seal element 184. The first seal element 184 includes an uphill-directed upper lip 186 and a downhill-directed lower lip 188. The lower lip 188 is reinforced by a ring-shaped spring 160 that places the lower lip 188 in tight engagement with the crankshaft 60 so as to form a seal therebetween. A second frame member 190 supports a dust lip 192, which is disposed below the lower lip 188 and projects toward the crankshaft 60. The dust lip 192 preferably is spaced slightly apart from the surface of the crankshaft 60, and thus generally does not create friction as the shaft spins. However, as pressure is applied, the space between the dust lip 192 and the shaft 60 is generally closed. The dust lip 192 shields the lower lip of the intermediate seal 180 from foreign matter such as dust, water and the like, and thus aids the lower lip 188. It is to be understood that, in other embodiments, each of the seals described herein can include at least one dust lip so as to aid the function of one or more seal lips.

Figure 6:
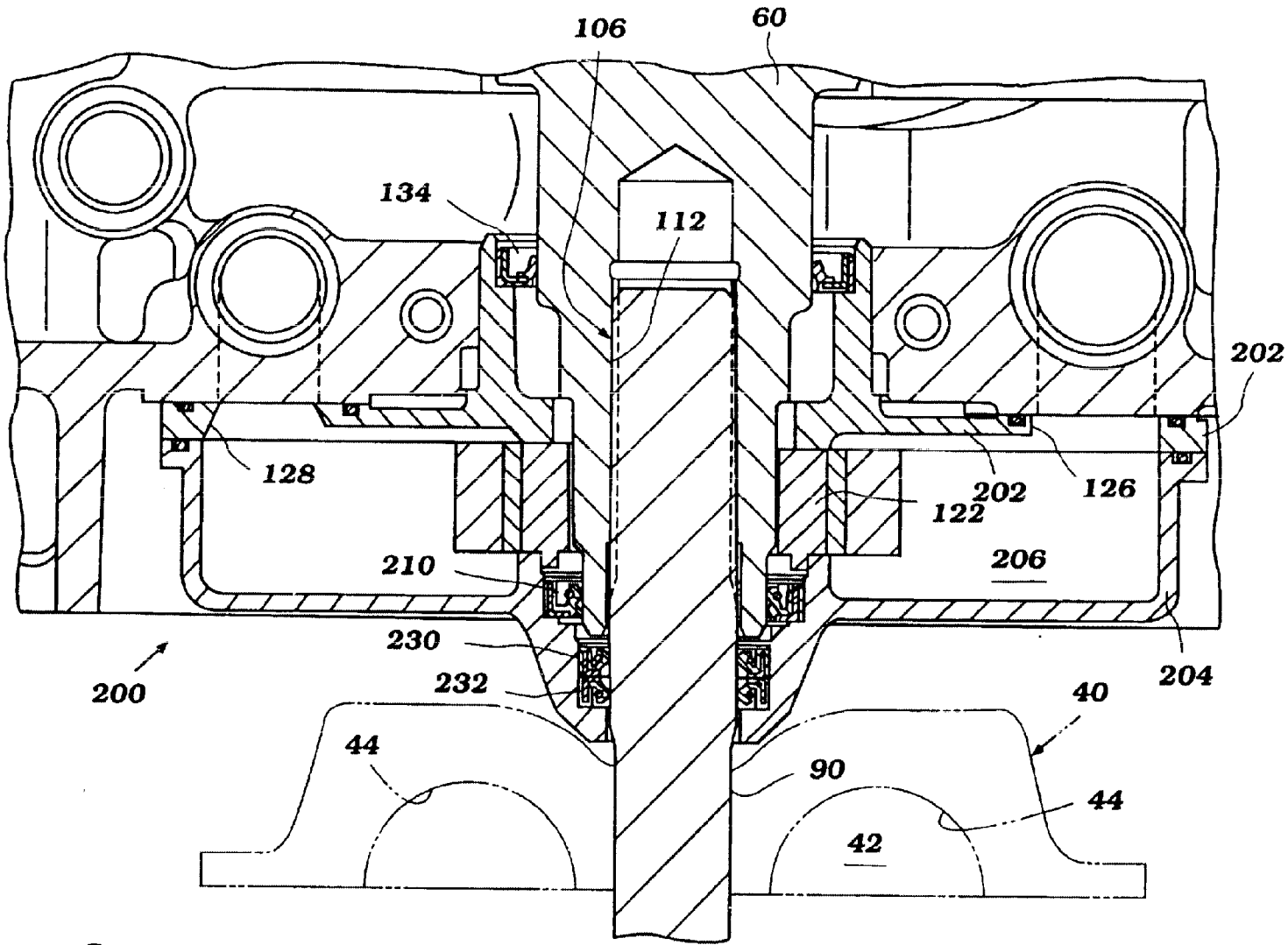
FIG. 6 is a partially sectioned view that enlarges another embodiment of an oil pump assembly shown in FIG. 1.
Figure 7:
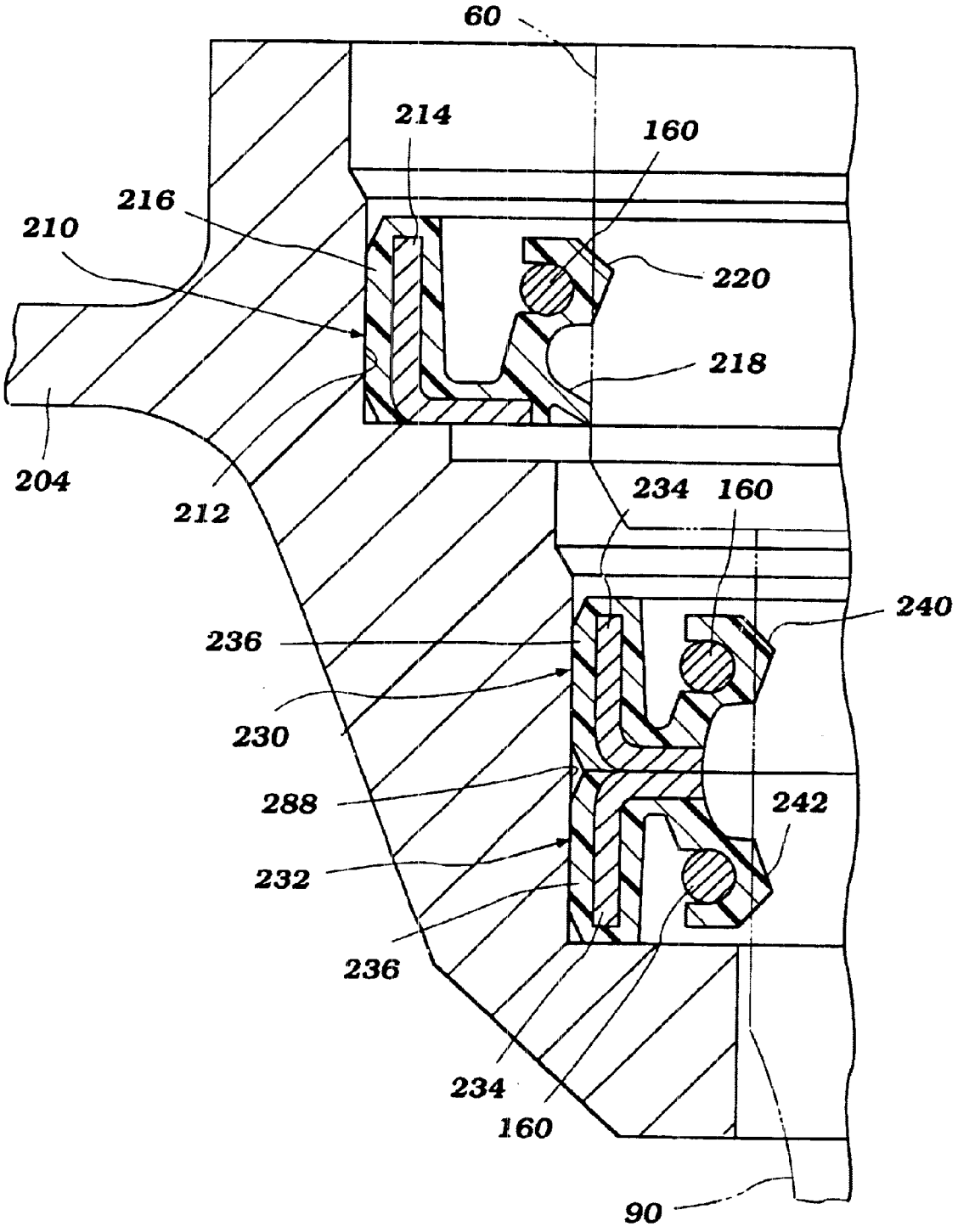
FIG. 7 is an enlarged close-up view of the oil pump assembly of FIG. 6.

With next reference to FIGS. 6 and 7, another embodiment of an oil pump assembly 200 is presented. The oil pump assembly 200 comprises an upper housing 202 and a lower housing 204 that cooperate to define a pump chamber 206. In this illustrated embodiment, an intermediate seal member 210 is disposed in an intermediate seat 212 formed in the lower pump housing 204. The intermediate seal member 210 comprises a frame 214 and a seal element 216. The seal element 216 has a downwardly directed dust lip 218 and an upwardly directed sealing lip 220. The sealing lip 220 includes a ring-shaped spring 160 for urging the lip 220 into a tight connection with the surface of the crankshaft 60.

A lower seat 228 is also formed in the oil pump lower housing 204. A first lower seal 230 and a second lower seal 232 are fit into the lower seat 228. Each of the first and second lower seals 230, 232 comprise a frame 234 and a seal element 236. Both seal elements 236 comprise sealing lips 240, 242 that are reinforced by ring-shaped springs 160.

FIG. 7 shows the disposition of the seals when the crankshaft 60 and driveshaft 90 are removed from the oil pump assembly 200 and the seals 230, 232 are at rest. Phantom lines indicate that the position the surfaces of the crankshaft 60 and driveshaft 90 will take when the shafts are installed. The seals 230, 232 are configured so that, when at rest, the sealing lips 240, 242 extend inwardly beyond the position of the shaft surfaces. When the shafts are installed, the sealing lips 240, 242 at least partially deform so as to conform to the respective shaft surface and create a secure seal.

With continued reference to FIGS. 6 and 7, the first and second lower seal members 230, 232 operate independently of one another but cooperate to create a tight seal in both the upward and downward directions. As shown, the second lower seal lip 242 is substantially downwardly directed, and thus is especially effective in inhibiting invasion of foreign matter, such as water and the like, upwardly past the seal member 232. The first lower seal lip 240 is substantially upwardly directed, and is thus especially effective in discouraging grease, oil and the like from leaking past the seal member 230 in a downwardly direction. As such, this arrangement protects oil within the pump chamber 206 from the invasion of foreign matter and inhibits oil from within the oil pump chamber 206 from leaking past the seal members 230, 232 and out of the lubrication system. If such oil were allowed to leak, it would likely coat the outboard motor mount 40 and the resilient dampeners 42 associated with the mount 40. Excessive oil contact with the dampener members 42 can result in premature wear of the dampener members 42.

Although this invention has been disclosed in the context of certain preferred embodiments and examples, and variations thereof, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure. It is also contemplated that various combinations or subcombinations of the specific features and aspects of the embodiments may be made and still fall within the scope of the invention. Accordingly, it should be understood that various features and aspects of the disclosed embodiments can be combined with or substituted for one another in order to form varying modes of the disclosed invention. Thus, it is intended that the scope of the present invention herein disclosed should not be limited by the particular disclosed embodiments described above, but should be determined only by a fair reading of the claims that follow.

What is claimed is:

1. An outboard motor comprising an engine having a substantially vertically-oriented crankshaft, a driveshaft coupled with the crankshaft of the engine so as to rotate therewith, and a lubrication system to supply lubricant to at least one component of the engine, the lubrication system comprising an oil pump assembly having a housing defining a pump chamber that at least substantially encircles a portion of the crankshaft, a rotor disposed within the pump chamber and configured to rotate with the crankshaft, a first seal member disposed above the chamber and configured to sealingly engage the crankshaft, a second seal member disposed below the chamber and configured to sealingly engage the crankshaft, and a third seal member disposed below the second seal member and configured to sealingly engage the driveshaft.

2. The outboard motor of claim 1, wherein a first seat, second seat, and third seat is formed in the housing, and the first seal, second seal and third seal, are fit into the first, second and third seats, respectively.

3. The outboard motor of claim 1, wherein the third seal comprises a seal lip, and a ring-shaped spring urges the seal lip into sealing contact with the driveshaft.

4. The outboard motor of claim 3, wherein the seal lip is generally downwardly inclined.

5. The outboard motor of claim 3, wherein the third seal comprises an upper seal lip, and a ring-shaped spring urges the upper seal lip into sealing contact with the driveshaft.

6. The outboard motor of claim 5, wherein the upper sealing lip is generally upwardly inclined.

7. The outboard motor of claim 3, wherein the second seal comprises a seal lip, and a ring-shaped spring urges the seal lip into sealing contact with the crankshaft.

8. The outboard motor of claim 1, wherein the second seal comprises a seal lip, a ring-shaped spring urging the seal lip into sealing contact with the crankshaft, and a dust lip disposed below the seal lip.

9. The outboard motor of claim 1, wherein the crankshaft has an axial opening formed in a bottom end thereof and the driveshaft has a tip that is inserted into the crankshaft opening to couple the crankshaft with the driveshaft.

10. A marine drive comprising an internal combustion engine adapted to drive a propulsion device through a rotating shaft, a lubrication system comprising an oil pump assembly, the pump assembly comprising a housing configured to circumferentially surround the shaft and defining a pump chamber, a rotor arranged within the pump chamber and configured to rotate with the shaft, and a seal arrangement comprising a lower seal member disposed below the pump chamber and comprising a seal lip adapted to slidably engage the shaft, and the seal lip extends toward the shaft in a downwardly-inclined direction.

11. The marine drive of claim 10, wherein a circular seat is formed in the housing, and the lower seal member fits in the seat.

12. The marine drive of claim 10, wherein the lower seal member comprises a circular rigid frame and a resilient sealing element, the sealing element comprising the seal lip.

13. The marine drive of claim 12, wherein a ring-shaped spring urges the seal lip into engagement with the shaft.

14. The marine drive of claim 10 additionally comprising a second lower seal disposed below the first lower seal, the second lower seal configured to sealingly engage the shaft.

15. The marine drive of claim 14, wherein the rotating shaft comprises a crankshaft coupled to a driveshaft at a coupling, and the first lower seal engages the crankshaft, and the second lower seal engages the driveshaft below the coupling.

16. The marine drive of claim 10 additionally comprising an upper seal disposed above the pump chamber and comprising an upwardly-inclined seal lip configured to sealingly engage the crankshaft.

17. The marine drive of claim 16, wherein the upper seal and the lower seal are configured so that there is less resistance to oil leaking upwardly from the chamber and past the upper seal than leaking downwardly and past the lower seal.

18. The marine drive of claim 17, wherein the oil pump assembly is mounted adjacent a crankcase of the engine, and oil that leaks upwardly past the upper seal enters the crankcase.

19. A marine drive comprising an internal combustion engine configured to drive a propulsion device and including a rotating vertical shaft, and a lubrication system comprising an oil pump assembly configured to be driven by the vertical shaft, the oil pump assembly comprising a housing defining a pump chamber through which the shaft extends, an upper seal member positioned above the pump chamber and configured to sealingly engage the shaft, and a lower seal member positioned below the pump chamber and configured to sealingly engage the shaft, the upper seal member configured so that oil will leak upwardly past the seal when oil pressure in the chamber exceeds a first threshold value, the lower seal member configured so that oil will leak downwardly past the seal when oil pressure in the chamber exceeds a second threshold value, and the first threshold value is less than the second threshold value.

20. The marine drive of claim 19 additionally comprising an oil collecting and draining system for collecting oil that leaks upwardly past the upper seal and draining the leaked oil back to the lubrication system.

21. The marine drive of claim 19, wherein the oil pump assembly is disposed adjacent a crankcase of the engine, and oil that leaks upwardly past the upper seal flows into the crankcase.

22. The marine drive of claim 19, wherein the upper seal member comprises an upwardly-inclined sealing lip that engages the shaft.

23. The marine drive of claim 22, wherein the lower seal member comprises a downwardly-inclined sealing lip that engages the shaft.

24. The marine drive of claim 23, wherein a ring-shaped spring urges the lower sealing lip into engagement with the shaft.

25. An outboard motor comprising a drive unit and a mounting mechanism for mounting the drive unit onto a watercraft, the mounting mechanism comprising at least one dampener adapted to dampen vibrations from the drive unit, the drive unit comprising a reciprocating internal combustion engine configured to drive a shaft as a result of reciprocal movement of at least one component of the engine, the engine comprising a lubrication system for delivering lubricant to at least one component of the engine, the lubrication system including a lubricant pump positioned vertically higher than the dampener and coupled with the shaft so that the shaft extends through a housing of the lubricant pump, the housing defining a pump chamber therewithin and comprising a first seal member disposed below the pump chamber, a second seal member below the first seal member, and a third seal member below the second seal member, each of the seal members being disposed circumferentially around the shaft, the first and second seal members being configured to inhibit lubricant from flowing down the shaft past the seal members, and the third seal member is configured to inhibit fluids from flowing up the shaft past the third seal member toward the chamber.

26. The outboard drive of claim 25, wherein the third seal is disposed adjacent at least one dampener.

27. The outboard drive of claim 26, wherein the dampener is the uppermost dampener.

28. The outboard drive of claim 25, wherein a circular seat is formed in the housing, and the second and third seal members are disposed in the seat.

29. The outboard drive of claim 25 additionally comprising an upper seal member disposed above the pump chamber and configured to inhibit fluids from passing downwardly past the upper seal member and into the pump chamber.

30. The outboard drive of claim 25, wherein the first seal comprises a sealing lip, and the sealing lip is generally upwardly inclined.

31. The outboard drive of claim 30, wherein the second seal comprises a sealing lip, and the sealing lip is generally upwardly inclined.

32. The outboard drive of claim 31, wherein the third seal comprises a sealing lip, and the sealing lip is generally downwardly inclined.

33. An outboard motor comprising a drive unit and a mounting mechanism for mounting the drive unit onto a watercraft, the mounting mechanism comprising at least one dampener adapted to dampen vibrations from the drive unit, the drive unit comprising a reciprocating internal combustion engine configured to drive a shaft assembly as a result of reciprocal movement of at least one component of the engine, the engine comprising a lubrication system for delivering lubricant to at least one component of the engine, the lubrication system including a lubricant pump positioned vertically higher than the dampener and coupled with the shaft assembly so that at least a portion of the shaft assembly extends through a housing of the lubricant pump, the housing defining a pump chamber therewithin and comprising a first seal member disposed below the pump chamber, a second seal member below the first seal member, and a third seal member below the second seal member, each of the seal members being disposed circumferentially around a portion of the shaft assembly, the first and second seal members being configured to inhibit lubricant from flowing down the shaft assembly past the seal members, and the third seal member being configured to inhibit fluids from flowing up the shaft assembly past the third seal member and toward the chamber.

34. The outboard drive of claim 33, wherein the shaft assembly comprises a crankshaft and a driveshaft that are coupled together at a coupling.

35. The outboard drive of claim 34, wherein the housing encloses at least a portion of the coupling.

* * * * *